US006478004B1

(12) United States Patent
Deng et al.

(10) Patent No.: US 6,478,004 B1
(45) Date of Patent: Nov. 12, 2002

(54) ENGINE FRONT COVER

(75) Inventors: Eddy D. Deng, Troy, MI (US); Franklin Lawrence Grawi, Novi, MI (US); Mark L. Stickler, Novi, MI (US); Rich Werth, Milan, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/682,703

(22) Filed: Oct. 8, 2001

(51) Int. Cl.[7] ..... F02F 7/00
(52) U.S. Cl. ..... 123/195 C
(58) Field of Search ..... 123/195 C

(56) References Cited

U.S. PATENT DOCUMENTS 4,122,820 A 10/1978 Ryberg ..... 123/198 E
4,498,433 A 2/1985 Ogawa ..... 123/90.38

*Primary Examiner*—Tony M. Argenbright
*Assistant Examiner*—Katrina B. Harris

(57) ABSTRACT

A cover 40 providing the boundary for a crankcase opening 16 of an internal combustion engine is provided. The cover includes a polymeric membrane 42 for enclosing the crankcase opening 16. The polymeric membrane has a crankshaft opening 19 and a plurality of fastener apertures 54 along its perimeter. A metal portion 60 is provided which is positioned adjacent to the polymeric membrane 42 having fastener apertures 64. The metal portion 60 provides a platform for mounting engine powered components.

12 Claims, 4 Drawing Sheets

ENGINE FRONT COVER

BACKGROUND OF INVENTION

The present invention relates to reciprocating piston internal combustion engines and, in particular, to a crankcase front cover for an automotive reciprocating piston internal combustion engine.

In the most recent three decades there has been a major push to increase the fuel economy of automotive vehicles. One technical trend to increase automotive fuel economy is to make the vehicle lighter. An excellent example of an automotive component that has been made lighter is the engine. Engine blocks are now typically fabricated from cast aluminum rather than prior cast iron. Many components, for example the intake manifold and valve covers are now fabricated from polymeric materials such as injection or blow molded plastics that can withstand high temperatures.

A reciprocating piston internal combustion engine has an engine block with a crankcase that is open along a front end to allow for installation of a crankshaft. The crankcase is enclosed by a fastener connected engine front cover that has a lower opening to allow for passage therethrough of the extreme front end of the crankshaft. The front cover has two functions. First, it provides a sealing pressure boundary for the crankcase to prevent escape of the lubricating oil from the engine. Second, it serves as a mounting member for mounting directly or via brackets, several engine belt-driven components, such as the air conditioning compressor, power steering pump, idler arms or other various pulleys which are typically engaged by a serpentine belt arrangement.

When an automotive engine is running, the engine cylinder block and heads induce vibration into the front cover. Accordingly, the front cover becomes a front sound pressure generator of the engine. It is often desirable in luxury class vehicles to minimize the sound emanating from the engine. Empirical studies have shown divergent strategies can minimize sound pressure generation from engine front covers. A first strategy is to provide a front cover with multiple pieces that is very stiff. The stiffness significantly increases the cover"s natural frequency. This approach has been found to function but is expensive compared to a one-piece cover. Also, since the crankcase opening is not covered by one continuous piece, there are more possible leak paths.

A second strategy to minimize sound pressure generation is to significantly lower the natural frequency of the front cover, particularly in the vicinity of the crankcase opening. The efficiency of sound transmission from a plate to the atmosphere is inversely proportional to the natural frequency of the plate. Therefore, lowering the natural frequency of the engine front cover can synergistically lower the sound pressure generation of the front cover. Lowering the frequency of vibration of the cover requires a very thin cover. However, providing the structural requirements of an engine front cover for its function of mounting engine belt-driven components limits the selection of suitable materials that have a lower natural frequency and the required strength. One practical material that offers the aforementioned requirements is magnesium. However, magnesium is highly cost prohibitive for such an application.

It is desirable to provide a front cover for a reciprocating piston internal combustion engine that is lighter than the current cast aluminum or iron covers. It is also desirable for such a front cover to have increased sound attenuation characteristics when compared to engine covers which are typically fabricated from stamped steel or cast aluminum.

SUMMARY OF INVENTION

In a preferred embodiment, the present invention brings forth a cover providing a boundary for a crankcase opening of an internal combustion engine. The cover includes a polymeric membrane sealably enclosing the crankcase opening. The polymeric membrane has an opening for passage of the crankshaft therethrough. The polymeric membrane has a plurality of fastener apertures along its perimeter to connect it to an engine crankcase. A metal portion is provided positioned adjacent to upper portions of the polymeric membrane and is bonded thereto. The metal portion has fastener apertures aligned with the fastener apertures of the polymeric membrane. The metal portion provides a platform for mounting pulleys powered by an engine powered belt. The cover provided herein has a natural frequency significantly lower than prior art metallic crankcase covers.

The present engine cover with its lower natural frequency, particularly in the vicinity of the crankshaft opening, has significant sound attenuation properties. Since the polymeric membrane is one piece, no additional leak paths are created, as with prior steel or cast aluminum covers.

Other advantages of the present invention will become more apparent to those skilled in the art from a reading of the following detailed description and reference to the drawings.

DETAILED DESCRIPTION

Figure 1:
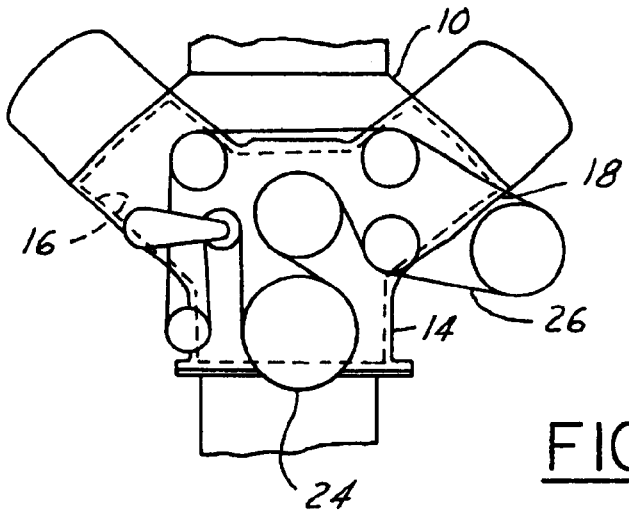
FIG. 1 is a front schematic view of a reciprocating piston internal combustion engine with pulleys and idler arms installed on a front cover.
Figure 2:
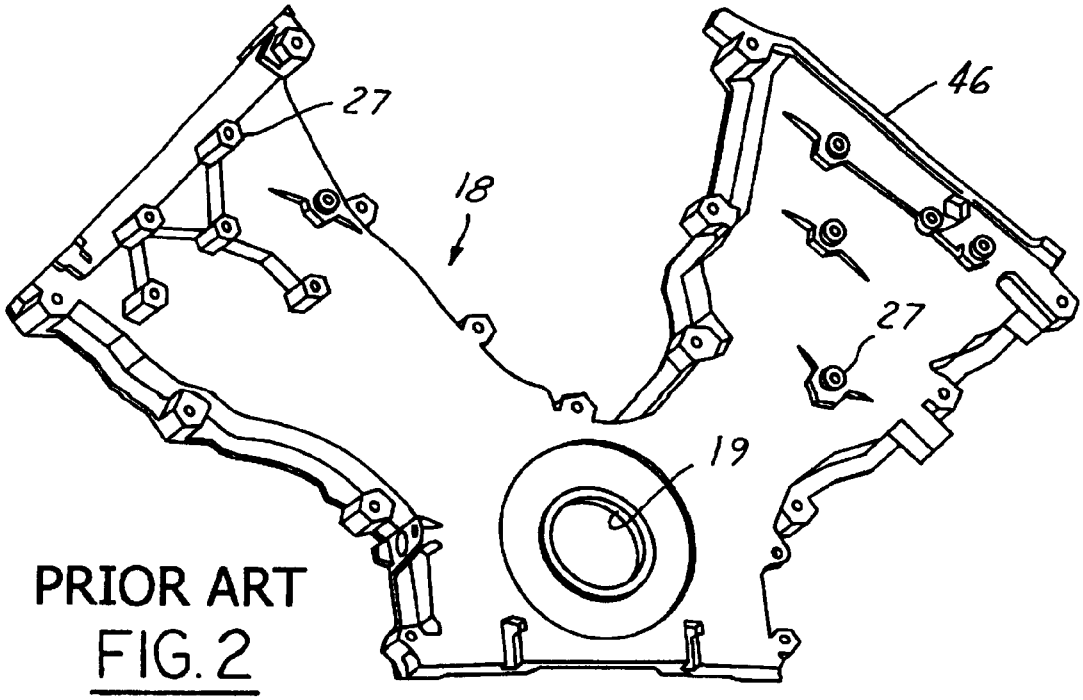
PRIOR ART FIG. 2
FIG. 2 is a front perspective view similar to that of FIG. 1, illustrating a prior art engine front crankcase cover fabricated from cast iron or aluminum.

Referring to FIGS. 1 and 2, a typical reciprocating piston internal combustion engine 6 has an engine block 10. A lower portion of the engine block 10 is typically referred to as the crankcase 14. The crankcase has an opening 16 along its front end. Sealably enclosing and providing a boundary for the front opening 16 is an engine front cover 18. The engine front cover 18 has an central opening 19 for passage of a front end of a crankshaft (not shown) therethrough. The crankshaft along its front end is fixably connected to a pulley 24. Engaged with the pulley 24 is a serpentine belt 26. The serpentine belt 26 powers various engine components such as the power steering pump, air conditioning compressor, alternator and in some vehicles the engine coolant fan.

Some components attached to the engine are mounted directly to the front cover 18 or on brackets attached to the front cover. The front cover 18 has bosses 27 to allow for connection of engine driven components or brackets. The front cover 18 is often utilized to mount idler pulleys for the serpentine belt and a belt tensioner. Accordingly, the front cover 18 must be strong enough to provide a platform for the engine powered components. As used herein, engine powered components not only refer to the actual pumps or alternators but also to idler pulleys and/or belt tensioners.

The front cover 18 is typically made from cast iron or aluminum. Although the cover 1 8 has been found to perform its function in an excellent manner it is desirable to provide an engine cover made of lighter materials.

Figure 3:
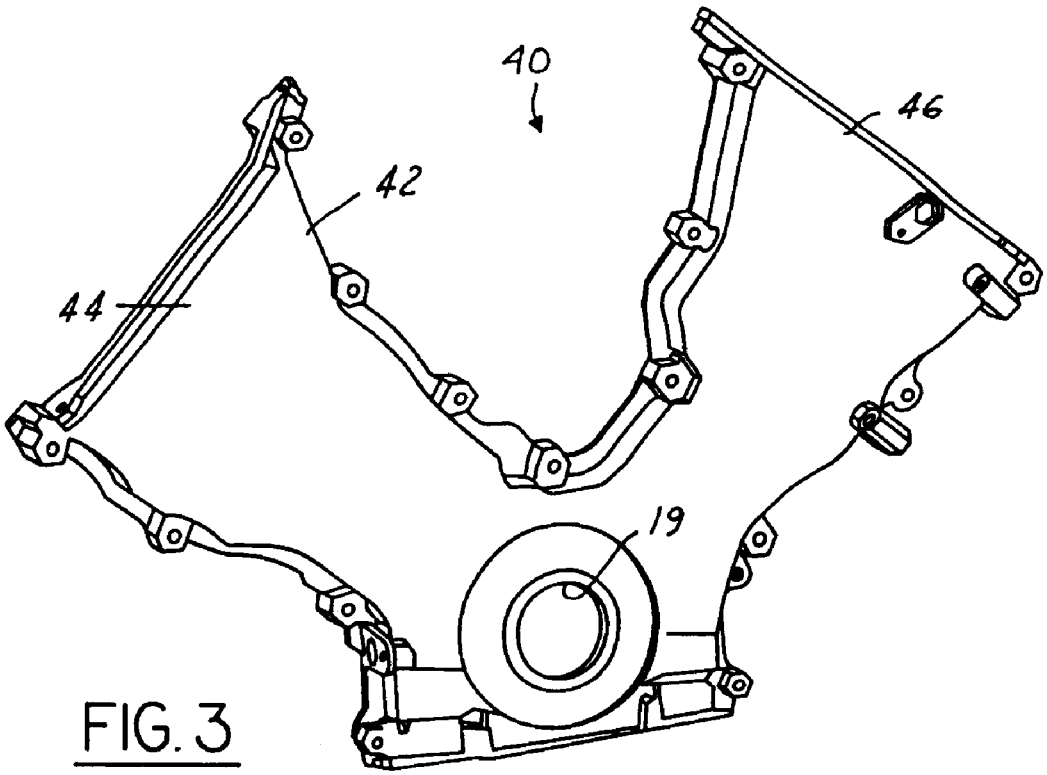
FIG. 3 is a front perspective view similar to FIG. 2, illustrating a polymeric membrane of an engine cover according to the present invention.
Figure 4:
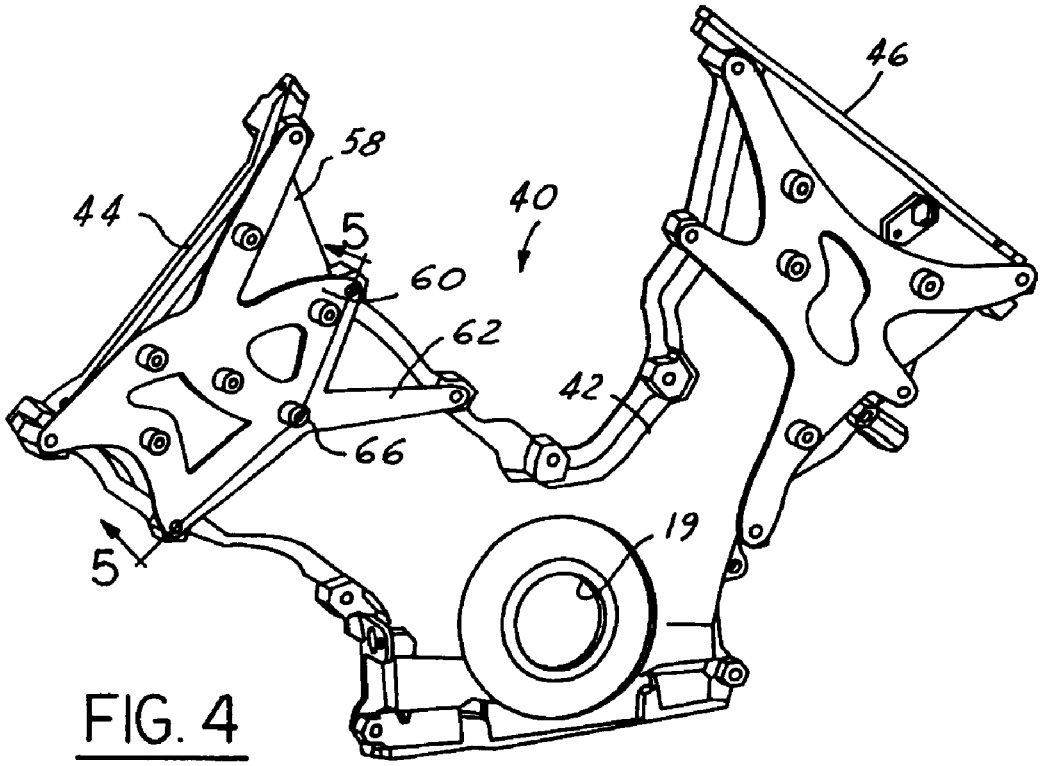
FIG. 4 is a front perspective view illustrating the polymeric membrane of FIG. 3 along with its metallic skeleton frame which is operatively associated therewith.
Figure 5:
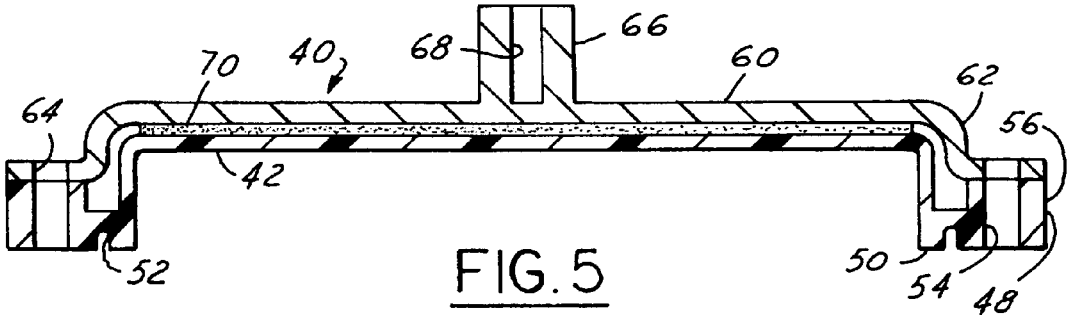
FIG. 5 is a sectional view of the engine front cover of FIG. 4 taken along lines 5—5 of FIG. 4.

FIGS. 3–5 show a preferred embodiment engine front cover 40 according to the present invention. The cover 40 has a polymeric membrane 42. The polymeric membrane 42 is typically made from injection molded, glass-reinforced nylon or sheet molded composite or other suitable alternatives which have adequate temperature and chemical resistant properties for use in an automotive engine. Typical thickness would be 2mm to 4mm. The polymeric membrane 42 has a central opening 19 for passage of a front end of a crankshaft (not shown) therethrough. As shown, the polymeric membrane has a generally wide configuration to fit the front cover of a V-type engine such as the V-6, V-8, V-10, or V-12. The polymeric membrane 42 has two legs 44 and 46. The polymeric membrane 42 along its perimeter has a flange 48 with sealing face 50. The sealing face 50 has a sealing ring groove 52. A sealing ring (not shown) is placed within the sealing groove to allow the polymeric membrane to sealably enclose the crankcase opening 16. The polymeric membrane along its perimeter also has a plurality of fastener apertures 54. The fastener apertures 54 are molded in fastener bosses 56 which are provided for reinforcement.

The separate legs 44, 46 each have an upper end 58. Positioned adjacent to leg 44 is a left side metal portion 60. The metal portion is a platform for mounting engine powered components. The metal portion 60 is provided by a skeleton 62 which extends between the perimeter edges of the polymeric membrane 42. Skeleton 62 has molded fastener apertures 64. Fastener apertures 64 are aligned with the fastener apertures 54 of the polymeric membrane. Integrally connected with the skeleton portion are bosses 66. The bosses 66 have a threaded blind bore 68 to allow for threaded attachment of an engine driven component such as a pulley pump and/or compressor, a belt tensioner or a bracket for any of the aforementioned. The metal skeleton 62 will typically be 4 mm to 6 mm in thickness and typically will be stamped steel or cast aluminum.

Skeleton 62 is connected to the polymeric membrane 42 by an adhesive 70. The adhesive 70 will typically be an elastomeric adhesive such as RTV silicone or vulcanized rubber with chemical and heat resistant properties, in addition to high mechanical damping. The adhesive 70 provides acoustic damping and prevents rattling due to induced vibration.

Figure 6:
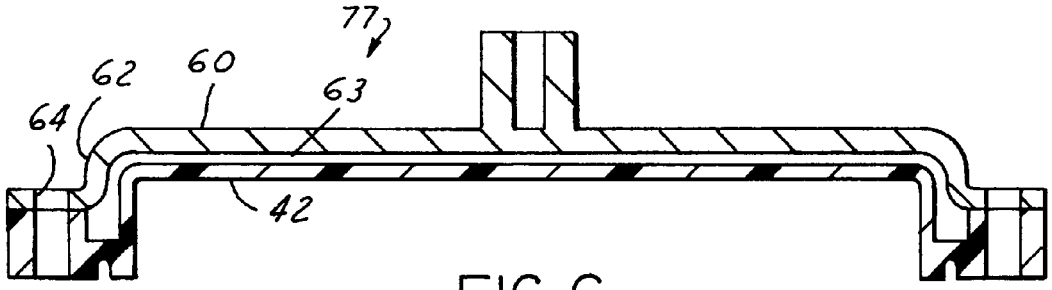
FIG. 6 is a view similar to FIG. 5 illustrating an alternate preferred embodiment engine front cover according to the present invention.

Referring now to FIG. 6, an alternate preferred embodiment engine front cover 77 according to the present invention is provided. Items performing identical functions are given similar reference numerals as aforedescribed. In the engine front cover 77, the adhesive 70 is not utilized and accordingly there exists a clearance 63 between the skeleton 62 and the polymeric membrane 42. Clearance 63 prevents rattling which can generate noise. If so desired, the dimensions of the metal skeleton and/or of the polymeric membrane may be modified to increase the clearance therebetween. This particular configuration may be preferable over the cover 40 because it requires no adhesive and may be cheaper to manufacture. In vehicles where sound attenuation is not as great a premium the front cover 77 may be highly desirable. In both embodiments 40, 77 the skeleton 62 can be a separate piece that is added on during the assembly operation. However, from a cost standpoint, it is typically preferable that the skeleton 62 be joined to the polymeric membrane 42 prior to engine assembly.

Figure 7:
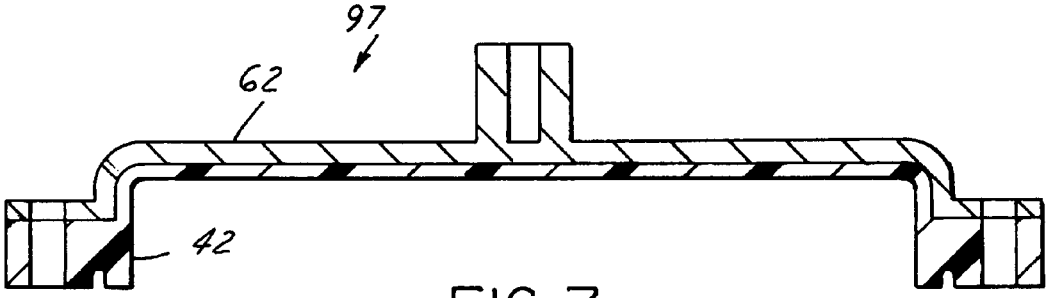
FIG. 7 is a view similar to FIG. 5 of another alternate preferred embodiment engine front cover according to the present invention.

Another alternate preferred embodiment engine front cover 97 is provided in FIG. 7. Parts providing similar functions are given like item numbers as aforedescribed. Skeleton 62 is insert molded into the polymeric membrane 42. This configuration prevents rattling and is extremely cheap to manufacture since the skeleton 62 can be placed within the mold when the polymeric membrane is fabricated.

Figure 8:
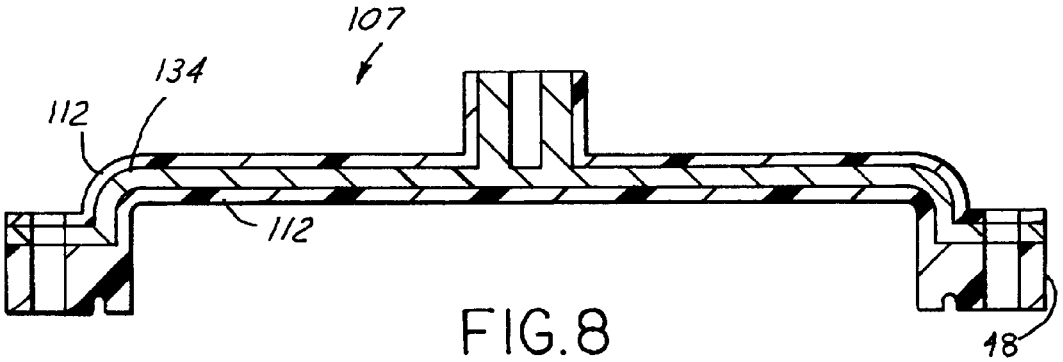
FIG. 8 is a view similar to FIG. 5 illustrating yet another alternate preferred embodiment engine front cover according to the present invention.

FIG. 8 shows another alternate preferred embodiment engine front cover 107 wherein the skeleton 134 is encapsulated within the polymeric membrane 112.

Figure 9:
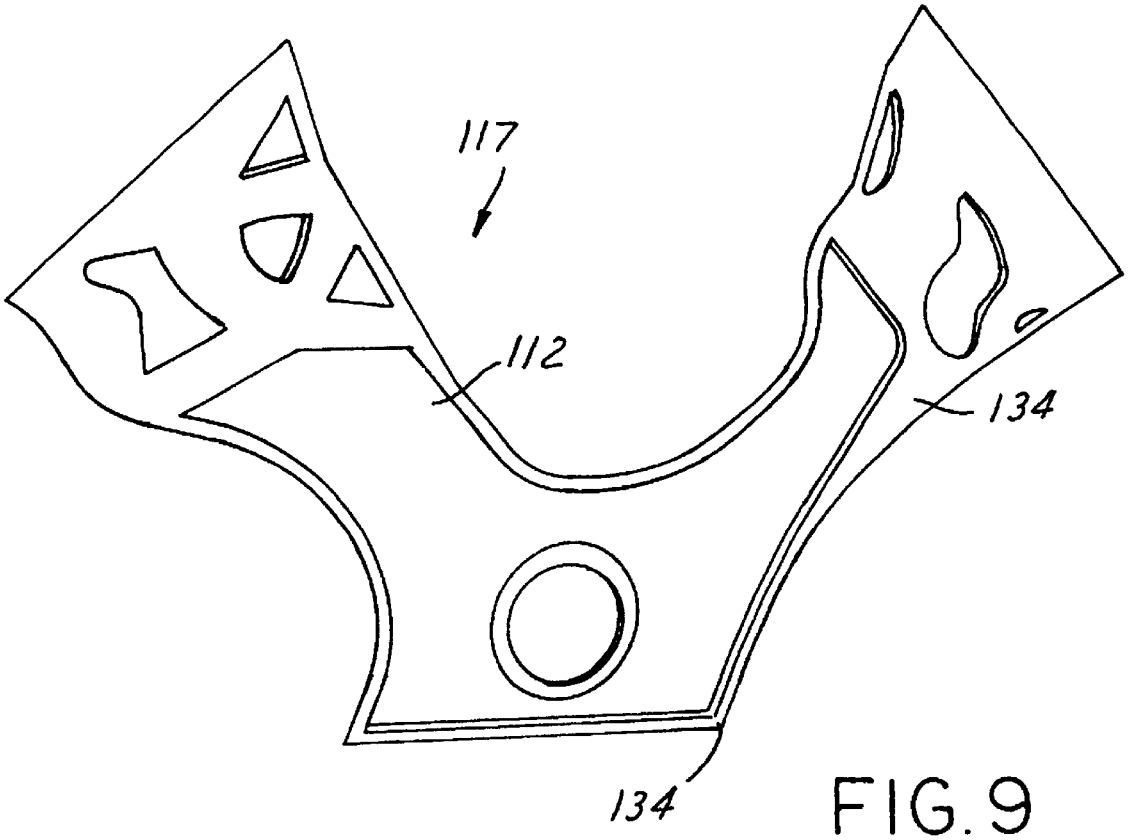
FIG. 9 is a view similar to FIG. 3 of still yet another preferred embodiment engine front cover according to the present invention.

Referring to FIG. 9, yet another alternate preferred embodiment engine front cover 117 is provided. Engine front cover 117 is similar to those aforedescribed with the exception that the skeleton 134 is extended along the total perimeter of the sealing flange 48 of the polymeric membrane 112. This configuration provides very effective sealing and also adds rigidity to the cover.

In all the embodiments aforedescribed, one unitary membrane provides the sealing of the crankcase opening resulting in very little opportunity for leakage. The inventive engine front covers 40, 97, 107, 117 are lighter than their previous metal counterparts.

Although the use of polymeric material typically lowers the natural frequency of vibration and therefore increases any noise problem, in this invention the use of the polymeric material lowers the efficiency of transmission of vibration to the surrounding air and accordingly the cover becomes quieter than the previous metallic cover. In many applications, the natural frequency of the present inventive cover can be lower than 500 HZ. In the range of 500 HZ, the efficiency of transmission of vibration is significantly lower.

While preferred embodiments of the present invention have been disclosed, it is to be understood that they have been disclosed by way of example only and that various modifications can be made without departing from the spirit and scope of the invention as it is encompassed in the following claims.

What is claimed is:

1. A cover providing a boundary for a crankcase opening of an internal combustion engine comprising:

a polymeric membrane for sealably enclosing said crankcase opening, said polymeric membrane having an opening for passage of a crankshaft therethrough and said polymeric membrane having a plurality of fastener apertures along a perimeter; and a metal portion positioned adjacent said polymeric membrane having fastener apertures aligned with said polymeric membrane fastener apertures, said metal portion providing a platform for mounting an engine powered component.

2. A cover as described in claim 1, wherein said metal portion is along an upper end of said cover.

3. A cover as described in claim 2, wherein said crankcase opening is a V-shaped opening and said cover has a shape of a V with separate legs, and said metal portion is along upper ends of said separate legs of said V.

4. A cover as described in claim 1, wherein said metal portion is a skeleton.

5. A cover as described in claim 1, wherein said metal portion extends around a perimeter of said polymeric membrane.

6. A cover as described in claim 1, wherein said metal portion is connected to said polymeric membrane by a damping material.

7. A cover as described in claim 1, wherein there is a general clearance between said metal portion in said polymeric membrane between said fastener apertures.

8. A cover as described in claim 1, wherein said metal portion is bonded with said polymeric membrane.

9. A cover as described in claim 8, wherein said metal portion is encapsulated by said polymeric member.

10. The cover as described in claim 1, wherein said cover has a natural frequency below 500 HZ.

11. A cover for providing a boundary for a crankcase opening of an internal combustion engine comprising:

a polymeric membrane for sealably enclosing said crankcase opening, said polymeric membrane having an opening for passage of a crankshaft therethrough, and said polymeric membrane having a plurality of fastener apertures along a perimeter to allow said polymeric membrane to be connected to an engine crankcase by fasteners;

a metal portion positioned adjacent said polymeric membrane along upper portions of said membrane, said metal portion being bonded to said membrane, said metal portion having fastener apertures aligned with said perimeter apertures of said polymeric membrane, said metal portion providing a platform for mounting pulleys powered by an engine powered belt; and wherein said cover has a lower natural frequency less than 500 HZ.

12. A reciprocating piston internal combustion engine comprising:

an engine block having a crankcase opening;

a cover for providing a boundary for said crankcase opening, said cover including;

a polymeric membrane for sealably enclosing said crankcase opening, said polymeric membrane having an opening for passage of a crankshaft therethrough and said polymeric membrane having a plurality of fastener apertures along a perimeter; and a metal portion positioned adjacent said polymeric membrane having fastener apertures aligned with said polymeric membrane fastener apertures, said metal portion providing a platform for mounting an engine powered component.

* * * * *